United States Patent [19]

Hanecker

[11] 4,009,538

[45] Mar. 1, 1977

[54] FIXTURE FOR CONVERTING A CENTERLESS GRINDER TO A CENTER GRINDER

[76] Inventor: John Hanecker, 1958-60 N. Seminary Ave., Chicago, Ill. 60614

[22] Filed: Jan. 8, 1975

[21] Appl. No.: 539,354

[52] U.S. Cl. ..... 51/103 C; 51/237 R; 51/241 R

[51] Int. Cl.[2] ..... B24B 5/04; B24B 41/06

[58] Field of Search ..... 51/103 R, 103 C, 105 R, 51/236, 237, 232, 241 R, 260

[56] References Cited

UNITED STATES PATENTS

| | | | |
|---|---|---|---|
| 1,528,188 | 3/1925 | Frost | 51/103 C X |
| 1,733,087 | 10/1929 | Heim | 51/103 C |
| 1,776,241 | 9/1930 | Caster et al. | 51/103 C |
| 2,303,459 | 12/1942 | Hinderer | 51/241 R |
| 2,626,488 | 1/1953 | Airlie | 51/241 R X |
| 3,729,300 | 4/1973 | MacKay | 51/103 R |
| 3,831,324 | 8/1974 | Wain | 51/237 R |

*Primary Examiner*—Al Lawrence Smith
*Assistant Examiner*—Nicholas P. Godici
*Attorney, Agent, or Firm*—Alan M. Abrams

[57] ABSTRACT

A fixture for converting a centerless grinder to a center grinder and the center grinder obtained thereby where such fixture comprises in combination a base member adapted for mounting on the support means of a centerless grinder, a headstock member slidably mounted on such base member having a first work center member and a tailstock member also slidably mounted on such base member disposed remotely from such headstock member and having a second work center member for supporting a work piece effectively through its central axis in co-operation with the first work center member of the headstock member. Employment of such fixture achieves high tolerance grinding for a cylindrical work piece about its true, dead center or central axis in high capacity, production operations.

7 Claims, 3 Drawing Figures

FIXTURE FOR CONVERTING A CENTERLESS GRINDER TO A CENTER GRINDER

This invention relates to a center grinder and more particularly to a fixture for converting or adapting a conventional centerless grinder to such center grinder.

Both center and centerless grinding are well known metal working procedures and various machines have been developed heretofore to effect such grinding operations. Typically however, because of the distinct differences in the two grinding procedures the practice has been to design a distinctly different machine for each type of grinding operation. Thus conventional grinding machines are constructed to perform either centerless or center grinding and not both types of grinding simultaneously or interchangeably on the same machine. This single machine concept for these two grinding operations has however generally precluded achieving the benefits of both types of grinding operations in a single operation. For example in centerless, cylindrical grinding the removal of stock by grinding is generally at a high or fast rate which renders such centerless grinding especially suitable for high volume or high capacity production operation. In addition such centerless grinding procedure typically achieves a highly uniform grinding with respect to the peripherial surface of the work piece and may be readily employed to effect either straight or multiple cuts over the entire length of the work piece simultaneously. Center cylindrical grinding in contrast is not often adaptable to high capacity production and typically requires careful centering and close alignment of the work centers to achieve acceptable grinding tolerances. However, when properly effected such center grinding produces an extremely high degree of accuracy and particularly with respect to grinding the external circumference or peripheral surface of the work piece uniformly with respect to the central axis or dead center of the work piece. Such degree of accuracy moreover is not usually obtainable in conventional centerless grinding operations.

It is therefore long been considered desirable to have a grinding machine capable of readily achieving the desired features of both types of grinding operations simultaneously in the same grinding operation and on a single machine. Moreover the established and conventional practice of having two separate machines for effecting these two different grinding operations has generally created a considerably economic burden for the typical machinist because of the necessity of maintaining two highly expensive machines for normal grinding operations. Accordingly, there has also been a considerably economic need for a simple fixture to readily convert a centerless grinder into a center grinder so as to achieve this highly desirable and unique combination of grinding operations on one single machine.

Therefore, an object of this invention is to provide a center grinder which simultaneously achieves the benefits of both center and centerless grinding and in particular both high capacity operation and high accuracy for grinding a cylindrical work piece uniformly about its true center or central axis. Another object is to provide a fixture capable of readily adapting or converting a centerless grinder to a center grinder with the resultant economic benefits achieved through the employment of one machine to perform two different grinding operations. These and other objects of this invention will be readily apparent from the following further detailed description thereof as well as from the attached drawings.

IN THE DRAWINGS

Figure 1:
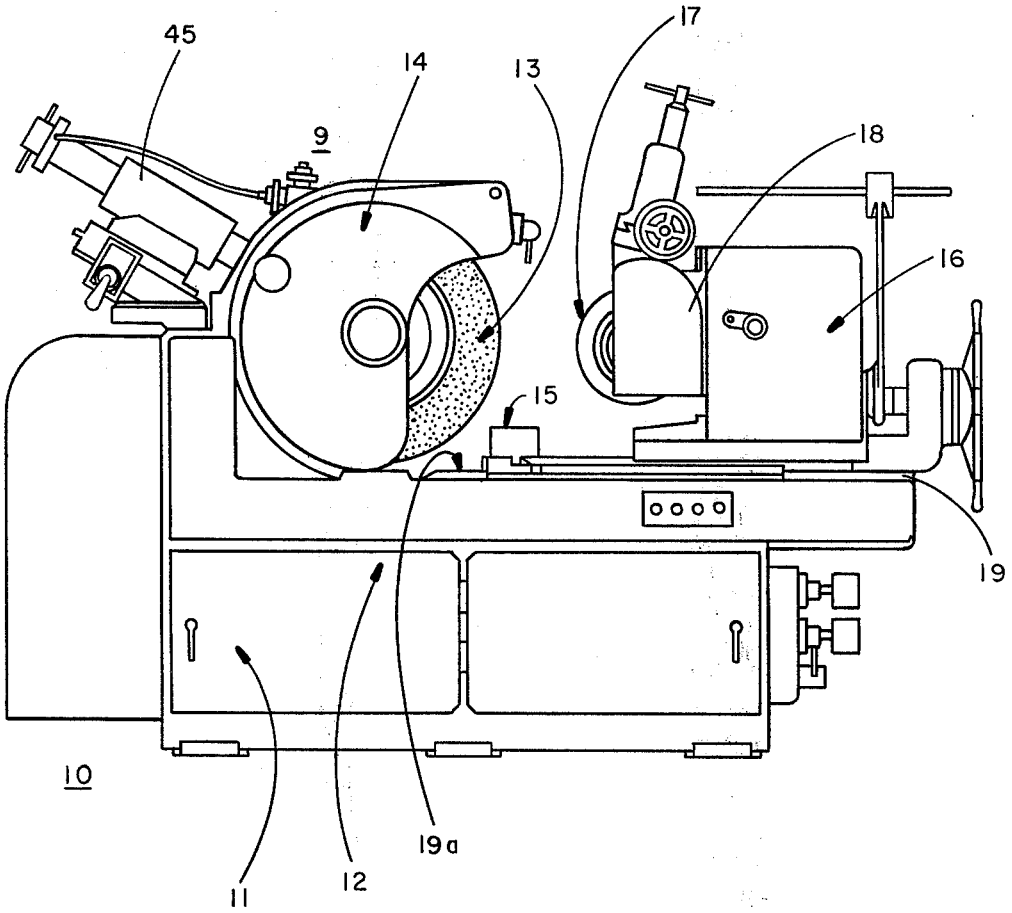
FIG. 1 is a front elevational view of a conventional centerless grinder.

In reference to FIG. 1, a conventional centerless grinder 9 is illustrated having in general combination a support means 10 comprising basically a frame support member 11 enclosed by housing 12 which supports in mounted arrangement a grinding wheel 13 generally covered by protective housing 14, a work rest and blade assembly 15 and a regulating wheel assembly 16 generally including a regulating wheel 17 and a housing 18 which contain internal drive means (not shown) for effecting horizontal movement of the regulating wheel assembly 16. Such regulating wheel assembly 16 in typical arrangement rests upon a moveable table or lower slide 19 which moves horizontally with respect to the stationary support means 11 on the upper surface **19*a* thereof so as to bring the regulating wheel 17 against a work piece (not shown) positioned upon the work rest assembly 15 and thus into abrasive or grinding contact with the grinding wheel 13. Internal the support means 10 and especially contained within the housing 12 are maintained the conventional motors and drive assemblies (not shown) for rotating the regulating wheel 17 and for driving the horizontal movement of the lower slide 19 as well as for rotating the grinding wheel 13**.

Figure 2:
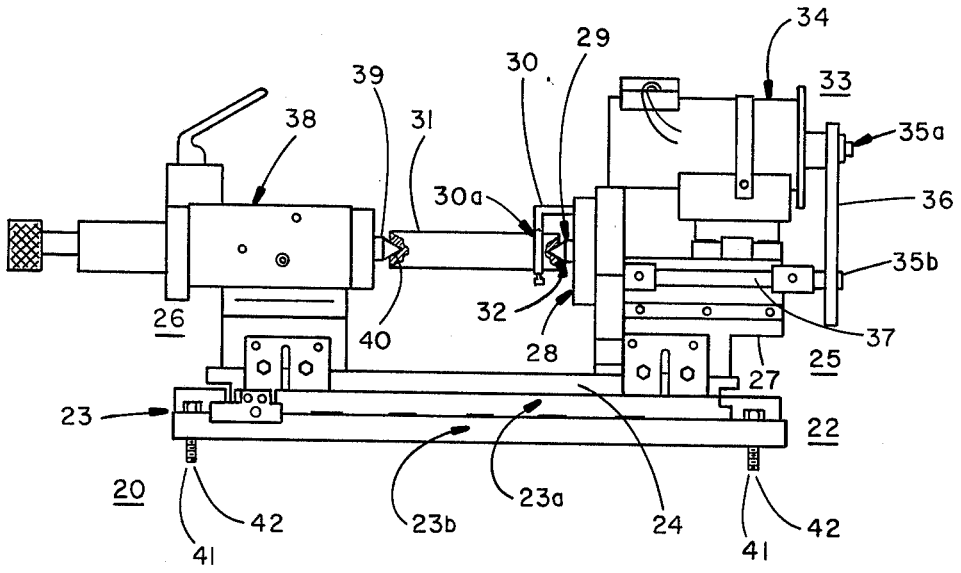
FIG. 2 is a front elevational view of a fixture of this invention for adapting the centerless grinder of FIG. 1 to the center grinder of this invention as represented by FIG. 3.
Figure 3:
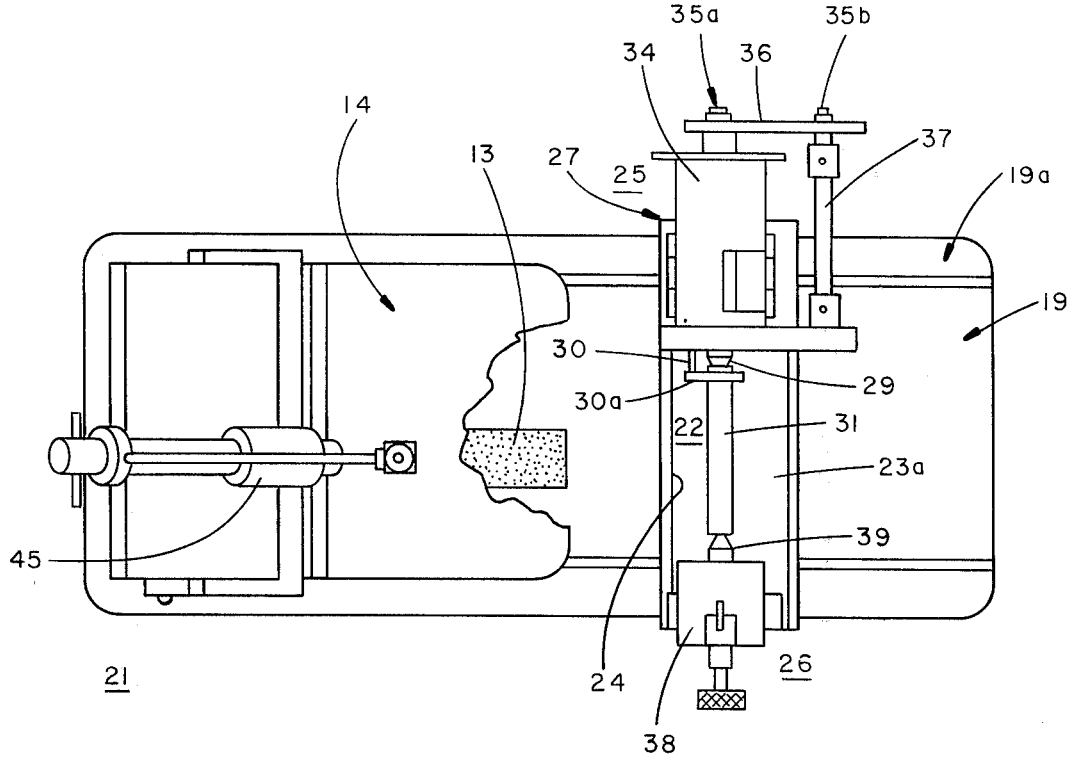
FIG. 3 is respectively top view of the center grinder of this invention, having portions broken away, with the fixture of FIG. 2 mounted on the centerless grinder of FIG. 1 after removal of the work rest and regulating wheel assemblies therefrom.

The fixture 20 of this invention is illustrated in simple embodiment in FIG. 2 and may be employed for converting or adapting the centerless grinder 9 of FIG. 1 into a center grinder of this invention as illustrated by center grinder 21 of FIG. 3. Such fixture 20 in basic arrangement has a base member 22 adapted for mounting, as more clearly explained hereinafter, on the support means 10 of the centerless grinder 9 after removing the work rest assembly 15 and the regulating wheel assembly 16 therefrom. Such base member 22 includes a swivel table 23 having an upper segment **23*a* and lower segment 23*b* pivotly interconnected by a pivot member (not shown) which permits and allows the upper segment 23*a* to be angularly rotated with respect to stationary lower segment 23*b*. Upper segment 23*a* has a guideway 24 integral with such segment and adapted so as to permit a headstock member 25 and a tailstock member 26 to be slidably mounted on such guideway 24 of the upper segment 23*a*. Headstock member 25 is of conventional construction and essentially combines a housing body 27 containing internal gearing (not shown) for rotating the face plate 28 rotatably mounted to the housing 27. Extending from a central position of the face plate 28 is a stationary dead work center or first center member 29. Positioned on the face plate 28 is work driving arm 30 connected with driving dog 30*a* which engages the cylindrical work piece 31 having a center hole 32 mated with first center member 29. Associated with the headstock member 25 are turning means 33 which in simple arrangement include a variable speed motor 34, step pulleys 335***a* and 35*b* interconnected by drive belt 36. Simple repositioning of such belt 36 on the different diameter sections of pulleys 35*a* and 35*b* as well as a speed variation of the motor 34 permits ready adjustment of the rotational speed of the face plate 28 and hence the work piece 31 linked through driving arm 30 and driving dog 30*a*. The step pulley 35*b* is typically interconnected to a jack shaft 37 which in turn is engaged internal the housing body 27 with the various gearing means (not shown) for rotating the face plate 28.

Disposed from the headstock member 25 and also slidably mounted on the guideway 24 of the upper segment 23*a* of the sliding swivel table 23 is tailstock member 26. In a simple embodiment tailstock member 26 includes a body 38 which supports a dead work center or second center member 39 which mates with center hole 40 of the work piece 31 and supports such work piece in co-action with the first center member 29 of the headstock member 25 effectively through the central axis of the work piece 31. The fixture 20 is adapted with suitable mounting means 41 for fixedly connecting the base member 22 to the support means 10 of the centerless grinder 9. In preferred arrangement such mounting means 41 include bolting members 42 which extend through the lower segment 23*b* of the base member 22, that is table 23, so as to fixedly connect the stationary lower segment 23*b* to the lower slide 19 of the support means 10 of the centerless grinder 9.

In adapting the centerless grinder 9 of FIG. 1 and to achieve the center grinder 21 of FIG. 3 the centerless grinder 9 is readily converted by simply removing the regulating wheel assembly 16 from the lower slide 19 and the work rest and blade assembly 15 from the support means 10. The fixture 20 is then positioned upon such lower slide 19 and securely locked thereon through application of bolting members 42. This mounted arrangement of the fixture 20 on the support means 10 or more specifically the lower slide 19 of the centerless grinder 9 is illustrated in FIG. 3.

In operating such center grinder 21, the work piece 31 is mounted between the first and second center members 29 and 39 of the headstock member 25 and tailstock member 26 of the base member 22 by suitable movement and locking of the headstock and tailstock members 25 and 26 upon the guideway 24 of the upper segment 23*a* (FIG. 2). Upon actuation of the motor 34 the work piece 31 is rotated through co-opertion of the driving arm 30 and driving dog 30*a* gripped about the work piece 31. The lower slide 19 is then actuated automatically or by hand to move horizontally forward and thus bring the rotating work piece 31 into grinding arrangement with the grinding wheel 13 of the centerless grinder 9 to achieve the designed grinding. Such lower slide may also be moved automatically on a predetermined cycle to hold the work piece 31 against the grinding wheel 13 until the desired level of stock is removed and then automatically retracted when such degree of grinding is achieved.

If the grinding is to be effected at an angle, for such purposes as shouldering, then the upper segment 23*a* may be rotated to the desired angle by pivotly rotating the upper segement 23*a* with respect to the lower segment 23*b* of the base member 22 locked in a stationary position on the lower slide 19 by the bolting members 42.

Mounted on the grinding wheel housing 14 of the centerless grinder 9 is truing assembly 45 which may be employed as in conventional practice to either dress the grinding wheel 13 or in suitable operation profile the surface of the grinding wheel 13 so as to induce on such grinding wheel 13 a desired contoured profile for grinding a particular work piece 31 into a conforming shape.

As so modified the centerless grinder 9, coverted into the center grinder 21 of this invention, is capable of grinding the work piece 31 readily with a high degree of grinding accuracy and production capacity by virtue of the fact that the work piece 31, in a centerless type grinding operation, is now also maintained between dead centers such as center members 29 and 39. Moreover by virtue of the employment of the fixture 20 the work piece 31 may be readily ground either with a simple cut or more especially with multi steps cuts in the high capacity production of centerless type grinding yet with the precision of center grinding with all of the step cuts being simultaneous ground with high precision with respect to the central axis of the work piece 31.

In describing the center grinder of this invention many of the details and structures of the centerless grinder 9 and certain of those relating to the headstock and tailstock members 25 and 26 and their respective functions and operation have been omitted for purposes of brevity because such details and structures, are well known to the skilled machinist. Moreover, in describing the center grinder of this invention, it should be understood that the embodiments described as preferred are only so described for purposes of illustration and description. The description of these preferred embodiments is not intended to limit the invention to the precise form or arrangement known and discussed. These embodiments, moreover, were chosen in order to conveniently explain the principles of the invention and their application and practical use so as to enable those skilled mechanics in the art to utilize the invention in various embodiments and modifications as are best adapted to their particular use contemplated.

I claim:

1. In a grinder having a grinding wheel mounted upon a support means of a centerless grinder with the regulating wheel and work rest assemblies removed from such support means and a fixture for converting such centerless grinder to a center grinder such fixture comprising a base member mounted on the support means, a headstock member slidably mounted on such base member having a first center member, a tailstock member slidably mounted on such base member disposed from such headstock member and having a second center member for supporting a work piece effectively through its central axis in co-action with the first center member, said base member being fixedly mounted on the support means of the centerless grinder in the position normally occupied by the work rest and regulating wheel assemblies so that the work piece supported by the first and second center members of the headstock and tailstock members respectively may be brought by movement of the support means into grinding contact with the grinding wheel while such work piece is effectively supported through its central axis by the center members.

2. The centerless grinder of claim 1 wherein the base member of the fixture comprises a swivel table having upper and lower segments with the upper segment having a guideway for slidably mounting the headstock and tailstock members, said upper and lower segments being pivotly interconnected so that the upper segment may be angularly displaced in reference to the stationary lower segment.

3. The centerless grinder of claim 1 wherein the base member of the fixture has mounting means for fixedly connecting such base member to the support means of the centerless grinder.

4. The centerless grinder of claim 3 wherein said mounting means comprises bolting members for connecting the stationary lower segment of the base member of the fixture to the support means of the centerless grinder.

5. The centerless grinder of claim 1 wherein the headstock member of the base member is associated with turning means for rotating the work piece supported between the first and second center members of the headstock and tailstock members respectively of the fixture.

6. The centerless grinder of claim 5 wherein such turning means include a motor and step pulleys interconnected by a driving belt and adapted for readily varying the rotational speed of the work piece.

7. The centerless grinder of claim 1 wherein the support means of the centerless grinder include a lower slide member capable of horizontal movement and adapted for ready receipt and connection with the fixture so that upon such horizontal movement of the lower slide, the work piece supported between the first and second center members of the headstock and and tailstock members respecitvely of the fixture may be brought into grinding contact with the grinding wheel of the centerless grinder.

* * * * *